US007344422B2

(12) United States Patent
Helmreich

(10) Patent No.: US 7,344,422 B2
(45) Date of Patent: Mar. 18, 2008

(54) ELECTRICAL COMPONENT, IN PARTICULAR RELAY SOCKET, HAVING SPRING CLAMPS, AND METHOD FOR THE MANUFACTURE THEREOF

(75) Inventor: Johannes Helmreich, Zwettl (AT)

(73) Assignee: Tyco Electronics Austria GmbH, Vienna (AT)

( * ) Notice: Subject to any disclaimer, the term of this patent is extended or adjusted under 35 U.S.C. 154(b) by 0 days.

(21) Appl. No.: 11/551,921

(22) Filed: Oct. 23, 2006

(65) Prior Publication Data

US 2007/0093121 A1 Apr. 26, 2007

(30) Foreign Application Priority Data

Oct. 24, 2005 (EP) ..... 05023154

(51) Int. Cl.
*H01R 4/48* (2006.01)

(52) U.S. Cl. ..... 439/835; 439/709

(58) Field of Classification Search ..... 439/441, 439/709, 715, 835, 861, 922
See application file for complete search history.

(56) References Cited

U.S. PATENT DOCUMENTS 6,270,384 B2 * 8/2001 Jaag ..... 439/835
6,786,779 B2 * 9/2004 Feldmeier et al. ..... 439/729
6,796,855 B2 * 9/2004 Fricke et al. ..... 439/835

FOREIGN PATENT DOCUMENTS

| | | |
|---|---|---|
| DE | 78 01 829 U1 | 6/1981 |
| DE | 298 06 097 U1 | 6/1998 |
| DE | 202 05 821 U1 | 8/2003 |
| EP | 1 515 397 A | 3/2005 |

* cited by examiner

*Primary Examiner*—Khiem Nguyen
(74) *Attorney, Agent, or Firm*—Barley Snyder LLC

(57) ABSTRACT

An electrical component, such as a relay socket, comprises a housing having at least one terminal provided with an insertion opening configured for receiving at least one conductor end. The insertion opening communicates with an assembly chamber formed in the terminal. A clamping device is arranged in the assembly chamber. The clamping device has a leaf spring divided into substantially parallel spring contacts by a parting slot. Each of the spring contacts is deflectable in a direction of insertion of the conductor end and has a free end positioned adjacent to a contact pressure plate such that a clamping slot is formed there between that force-fittingly receives the conductor end. A conductor element may additionally extend from the clamping device and be force-fittingly connected between the free ends of the spring contacts and the contact pressure plate to form a single piece pre-assembled unit with the clamping device.

14 Claims, 4 Drawing Sheets

ELECTRICAL COMPONENT, IN PARTICULAR RELAY SOCKET, HAVING SPRING CLAMPS, AND METHOD FOR THE MANUFACTURE THEREOF

FIELD OF THE INVENTION

The invention relates to an electrical component, such as a relay socket, having a housing and at least one terminal for connecting at least one conductor end. The terminal is provided with at least one insertion opening which extends in a direction of insertion of the conductor end into the housing and a clamping device which allows the conductor end to be force-fittingly fixed in a conductor receiving chamber therein.

BACKGROUND OF THE INVENTION

Electrical components that have a housing and at least one terminal for connecting at least one conductor end are known from the prior art. Traditionally, screw clamps or strain relief clamps are used to connect the conductor ends when the conductor end is introduced into a clamping slot delimited by an electrically conductive contact pressure plate. The contact pressure plate is pressed onto the conductor end by the clamp to narrow the clamping slot and electrically connect the conductor end to the component. A force-fitting connection between the conductor end and the electrical component is thereby created, which ensures that the conductor end is not inadvertently loosened.

Disadvantageously, this type of terminal not only requires a tool to actuate the clamp but also the clamping step is timely. Moreover, it is very difficult to insert and clamp more than one conductor at a time into this type of clamp, in particular in relay sockets where a plurality of relays may have to be linked for simultaneous actuation.

BRIEF SUMMARY OF THE INVENTION

It is therefore an object of the invention is to provide an electrical component, such as a relay socket, wherein it is relatively simple to connect a plurality of conductor ends.

This and other objects are achieved by an electrical component comprising a housing having at least one terminal provided with an insertion opening configured for receiving at least one conductor end. The insertion opening communicates with an assembly chamber formed in the terminal. A clamping device is arranged in the assembly chamber. The clamping device has a leaf spring divided into at least two substantially parallel spring contacts by a parting slot. Each of the spring contacts is deflectable in a direction of insertion of the conductor end and has a free end positioned adjacent to a contact pressure plate such that a clamping slot is formed there between that force-fittingly receives the conductor end. A conductor element may additionally extend from the clamping device and be force-fittingly connected between the free ends of the spring arms and the contact pressure plate to form a single piece pre-assembled unit with the clamping device.

This and other objects are further achieved by a method for manufacturing an electronic component provided with a clamping device and a conductor element, comprising the steps of: providing the clamping device with a leaf spring divided into at least two substantially parallel spring contacts by a parting slot, each of the spring contacts being deflectable and having a free end positioned adjacent to a contact pressure plate such that a clamping slot is formed there between; connecting the conductor element to the clamping device in a force-fitting manner by positioning a support member of the conductor element between the free ends of the spring contacts and the contact pressure plate such that the free ends of the spring members engage the support member to force-fittingly attach the conductor element to the clamping device to form a single piece pre-assembled unit; and inserting the single piece pre-assembled unit into a housing of the electrical component.

DETAILED DESCRIPTION OF THE INVENTION

Figure 1:
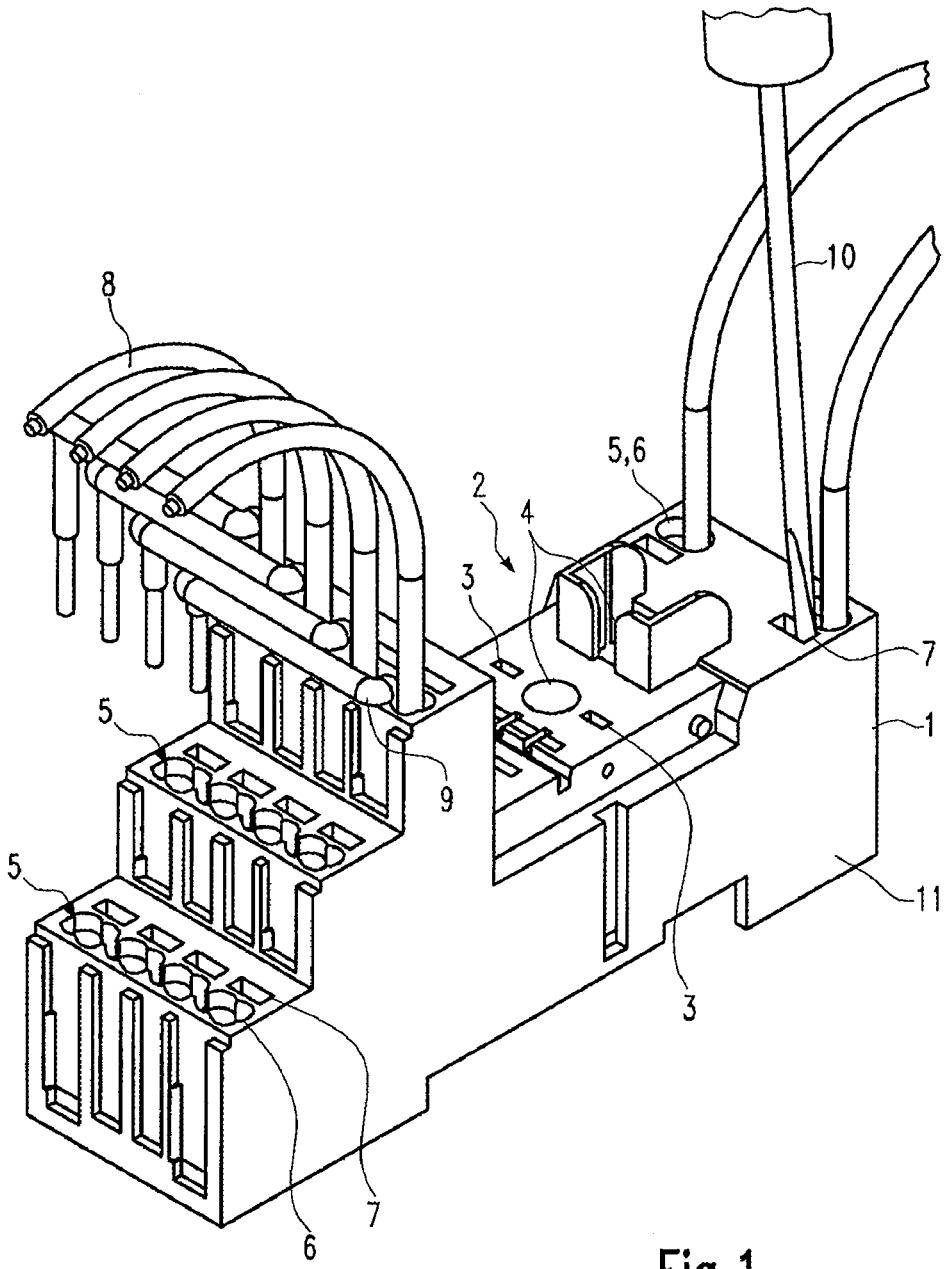
FIG. 1 shows a diagrammatic perspective view of an electrical component in the form of a relay socket according to the invention.

FIG. 1 shows an electrical component according to the invention. As shown in FIG. 1, the electrical component in the illustrated embodiment is configured as a relay socket 1. The relay socket 1 has a receiving region 2 configured for receiving a relay (not shown). The receiving region 2 includes plug contacts 3 configured for receiving pins (not shown) of the relay (not shown) and positioning devices 4 configured for precisely positioning the relay (not shown) in the receiving region 2.

As shown in FIG. 1, a plurality of terminals 5 are connected by conductor elements 18 (FIG. 2) to the plug contacts 3. Each of the terminals 5 is provided with at least one insertion opening 6 and at least one actuation opening 7. Alternatively, a single actuation opening 7 may be provided that extends adjacent to all of the insertion openings 6. At least one conductor 8 and/or at least one linking member 9 may be received in the insertion openings 6. An internal contour of the insertion opening 6 corresponds to an external contour of the linking members 9 and/or the conductors 8, which are arranged next to one another, so that the linking members 9 and/or the conductors 8 are individually supported and positioned by a wall of the insertion opening 6. A tool 10, such as a screwdriver, may be introduced through the actuation opening 7 in order to detach the conductors 8 and/or the linking members 9 from the terminal 5.

The receiving region 2 with the openings for the plug contacts 3 and the positioning devices 4 and the terminals 5 with the insertion openings 6 and the actuation openings 7 are formed within a housing 11 made, for example, of a plastic material. The housing 11 is formed with these elements in one operating step, such as by injection molding.

Figure 2:
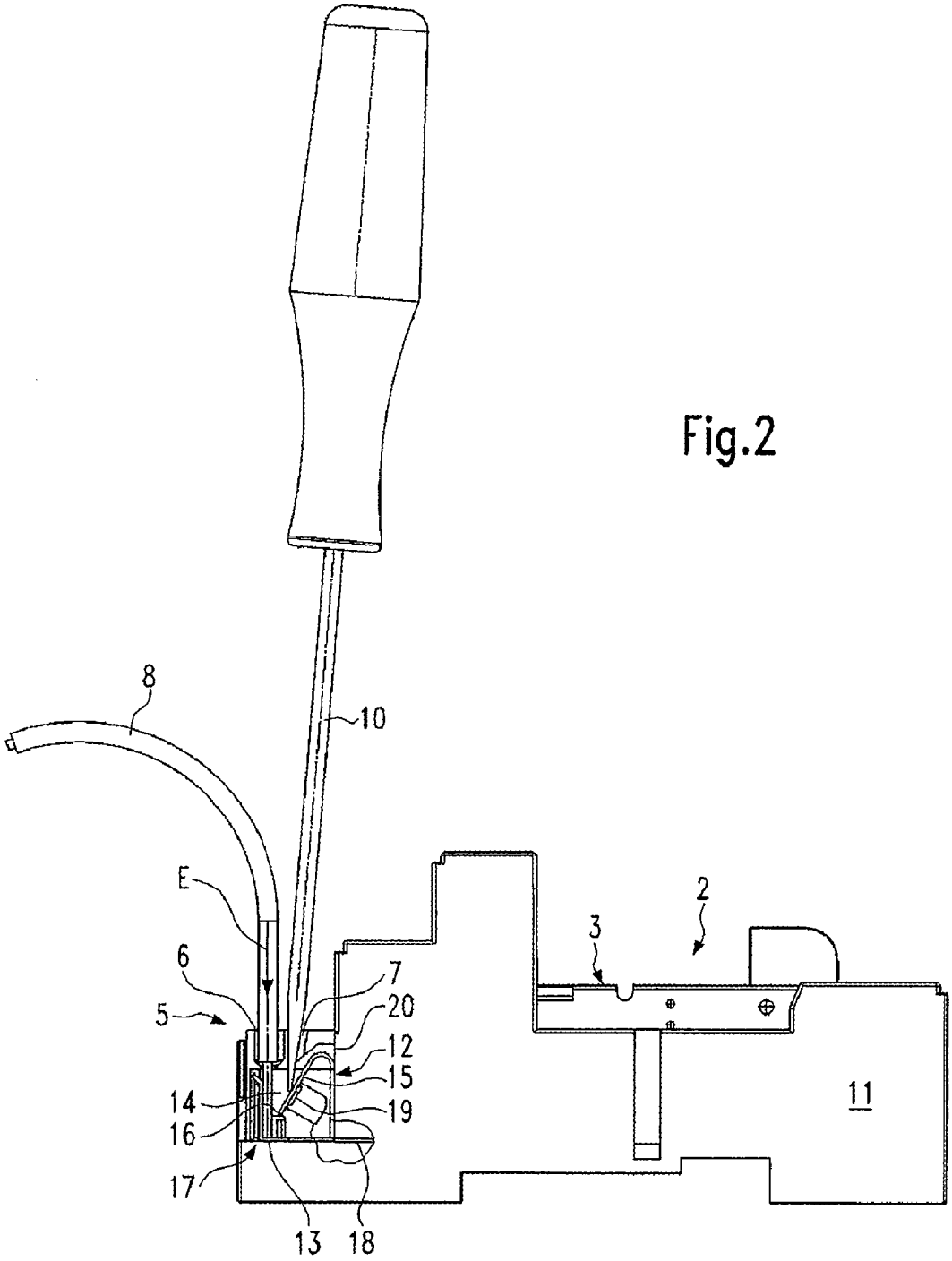
FIG. 2 shows a partial sectional diagrammatic side view of the electrical component of FIG. 1.

As shown in FIG. 2, the terminal 5 includes an assembly chamber 17. A clamping device 12 is arranged in the assembly chamber 17 and includes a substantially cuboidal cage 20 that forms a conductor end receiving chamber 14. The conductor element 18 extends from the clamping device 12 to the plug contact 3 of the receiving region 2 and connects the clamping device 12 to the terminal 5. The conductor element 18 and the clamping device 12 may be formed, for example, by stamping. The clamping device 12 may be formed, for example, from an electrically conductive stamped sheet metal. The metal may be, for example, a heat-treated steel. The heat-treated steel may be, for example, a chromium-nickel steel such as X12CrNi177.

Figure 3:
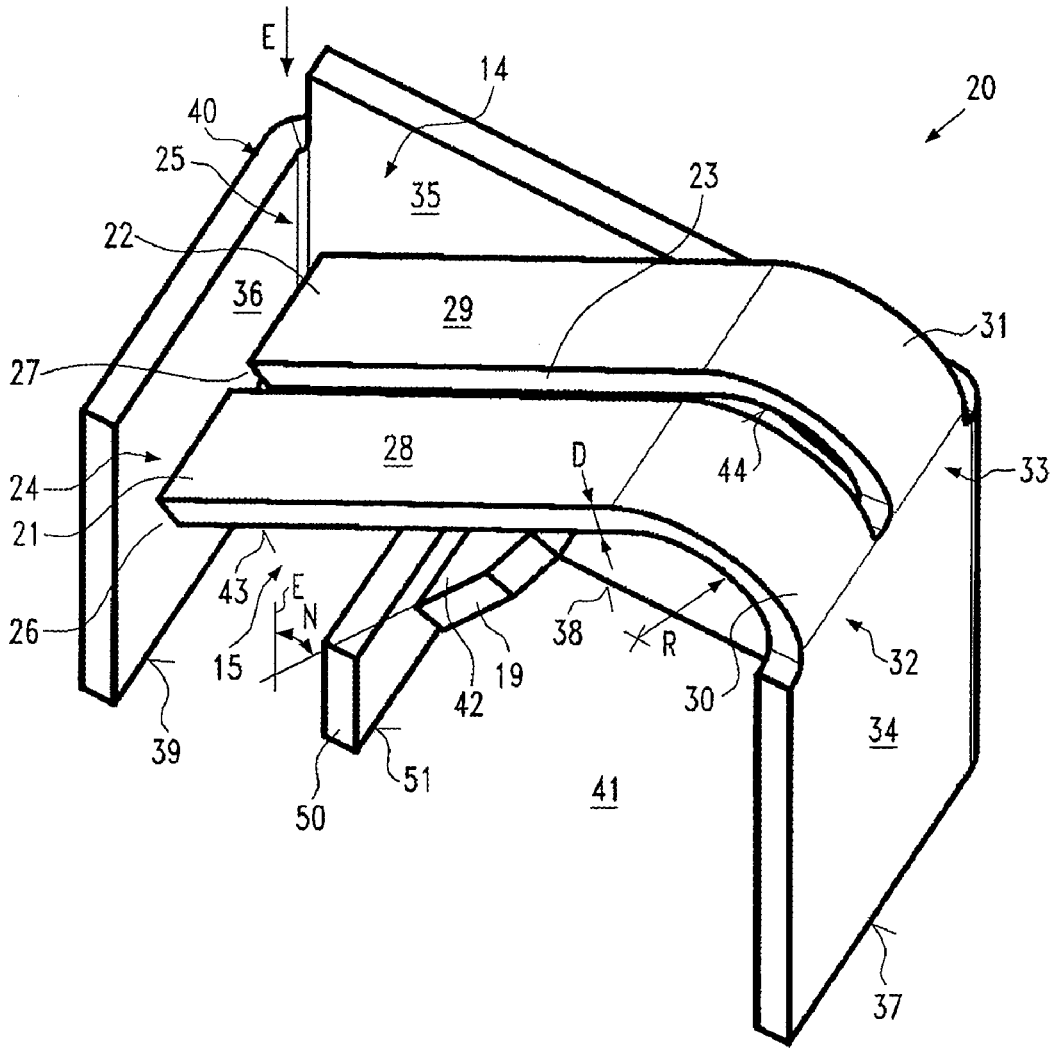
FIG. 3 shows a diagrammatic perspective view of a clamping device according to the invention.

As shown in FIG. 3, the clamping device 12 includes the cage 20. The cage 20 may be, for example, a one-piece stamped member made from an electrically conductive sheet metal, such as chromium-nickel steel. A leaf spring 15 is integrally formed with the cage 20 and extends from the cage 20 into the conductor end receiving chamber 14. The leaf spring 15 is divided into at least two substantially parallel spring contacts 21, 22, which are separated from one another by at least one parting slot 23. At a free end 24, 25 of each of the spring contacts 21, 22 is a clamping slot 26, 27, respectively. The leaf spring 15, which forms the spring contacts 21, 22, may be made in one piece from a stamped member with the parting slot 23 formed in the stamped member by incision or stamping. The shaping may be produced, for example, by forming.

The clamping slots 26, 27 are configured to receive a conductor end 13 of the conductor 8, which has been stripped of its insulation, as shown in FIG. 2. The conductor end 13 is pushed through the insertion opening 6 into the conductor end receiving chamber 14 in a direction of insertion E and is force-fittingly fixed by the leaf spring 15 in a main clamping slot 16 formed by the clamping slots 26, 27 by the resilient deflection of the respective spring contact 21, 22 in the direction of insertion E. As shown in FIG. 3, at rear faces of the spring contacts 21, 2 and pointing into the conductor end receiving chamber 14, the spring contacts 21, 22 have a substantially rectilinear guide slope 28, 29 inclined in the direction of insertion E that narrows the conductor end receiving chamber 14 in the direction of insertion E towards the clamping slots 26, 27. The guide slopes 28, 29 guide the conductor end 13 to the clamping slots 26, 27 and prevent the conductor end 13 from becoming caught. Because the guide slopes 28, 29 are substantially rectilinear, the conductor end 13 is guided uniformly towards the clamping slots 26, 27.

Adjoining the guide slopes 28, 29 on sides remote from the clamping slots 26, 27 is a transition radius R, which forms a curved deformation region 30, 31. The transition radius R extends in a longitudinal direction of the spring contacts 21, 22 and is a plurality of times as large as a thickness D of the material. As a result of the shaping of the spring contacts 21, 22, the stresses which occur when the conductor end 13 is pressed against the guide slopes 28, 29 of the spring contacts 21, 22 are concentrated in the respective deformation regions 30, 31. As a result, the elastic deformation of the spring contacts 21, 22 substantially takes place at the deformation regions 30, 31, while the guide slopes 28, 29 remain substantially un-deformed.

The concentration of the elastic deformation in the deformation region 30, 31 is achieved in that mechanical stresses in the deformation region 30, 31 are increased by the shaping given to the spring contacts 21, 22 in the deformation region 30, 31 and the deflection capacity at this point is greater than in other portions of the spring contacts 21, 22. This may be achieved for example in that the cross-sectional area of the spring contacts 21, 22 is reduced in the deformation region 30, 31. However, this measure carries with it the risk of permanent ruptures because of the notching effect of a narrowing of this kind. For this reason, it is preferable if the stresses in the spring contacts 21, 22 are increased by the transition radius R in the deformation region 30, 31, which extends in a longitudinal direction of the spring contacts 21, 22, by making the transition radius R a multiple of the thickness of the material of the spring contacts 21, 22.

At ends 32, 33 of the deformation regions 30, 31 opposite from the free ends 24, 25, the spring contacts 21, 22 are connected to one another by a rear plate 34. The rear plate 34 extends in the direction of insertion E and has a substantially rectangular shape. A substantially rectangular side plate 35 extends from a side of the rear plate 34. The side plate 35 extends substantially transversely with respect to the direction of insertion E from the rear plate 34 and over substantially the entire length of the spring contacts 21, 22.

A contact pressure plate 36 extends from the side plate 35 at an end opposite to the rear plate 34. The contact pressure plate 36 has a height in the direction of insertion E somewhat smaller than a height of the side plate 35 such that a recess 40 is formed. The contact pressure plate 36 is configured such that the contact pressure plate 36 is arranged opposite the free ends 24, 25 of the spring contacts 21, 22 to form the clamping slots 26, 27. The contact pressure plate 36 therefore absorbs the clamping forces generated by the spring contacts 21, 22. Because the free ends 24, 25 of the spring contacts 21, 22 are inclined in the direction of insertion E, a tensile force on the conductor end 13 in a direction opposite to the direction of insertion E causes the spring contacts 21, 22 to try to move up into a horizontal position and therefore causes the spring contacts 21, 22 to press more forcefully against the contact pressure plate 36, which increases the clamping forces absorbed by the contact pressure plate 36.

An underside 37 of the rear plate 34, an underside 38 of the side plate 35, and an underside 39 of the contact pressure plate 36 lie in substantially the same plane to form a common base surface. The plane of the undersides 37, 38, 39 extends substantially perpendicular to the direction of insertion E. The rear plate 34, the side plate 35, and the contact pressure plate 36 form side faces of the cage 20, which define the conductor end receiving chamber 14. The spring contacts 21, 22 extend into an interior space 41 of the cage 20 and into the conductor end receiving chamber 14. The rear plate 34, the side plate 35, and the contact pressure plate 36 may be formed, for example, from double folding approximately 90° an originally planar starting plate of the stamping material around the interior space 41.

A stop 19 is stamped out of the side plate 35 of the cage 20 and turned into the interior space 41 of the cage 20. As shown in FIG. 2, the stop 19 is arranged substantially opposite from the actuation opening 7 such that the force acting on the guide slopes 28, 29 through the tool 10 is directly taken up by the stop 19. In this arrangement, the stamping is such that an oblique turned fold and hence an abutment face 42 extending obliquely in relation to the direction of insertion E and inclined in a direction of the clamping slots 28, 29 is formed. In the illustrated embodiment, an incline N of the abutment face 42 in relation to the direction of insertion E is dimensioned such that undersides 43, 44 of the spring contacts 21, 22 lie on the abutment face 42 over substantially the entire surface when the spring contacts 21, 22 are deflected resiliently in the direction of insertion E away from their rest position shown in FIG. 3 and into their release position shown in FIG. 2. In the illustrated embodiment, in the rest position the abutment face 42 is spaced from the undersides 43, 44 of the spring contacts 21, 22 such that the spring contacts 21, 22 can only be moved towards the abutment face 42 without plastic deformation.

As shown in FIG. 3, a holding lug 50 is stamped out of the side plate 35 and is bent into the interior space 41. The holding lug 50 extends substantially parallel to the contact pressure plate 36 and the rear plate 34. An underside 51 of the holding lug 50 lies in a plane with the undersides 37, 38, 39 of the rear plate 34, the side plate 35, and the contact pressure plate 36.

Figure 4:
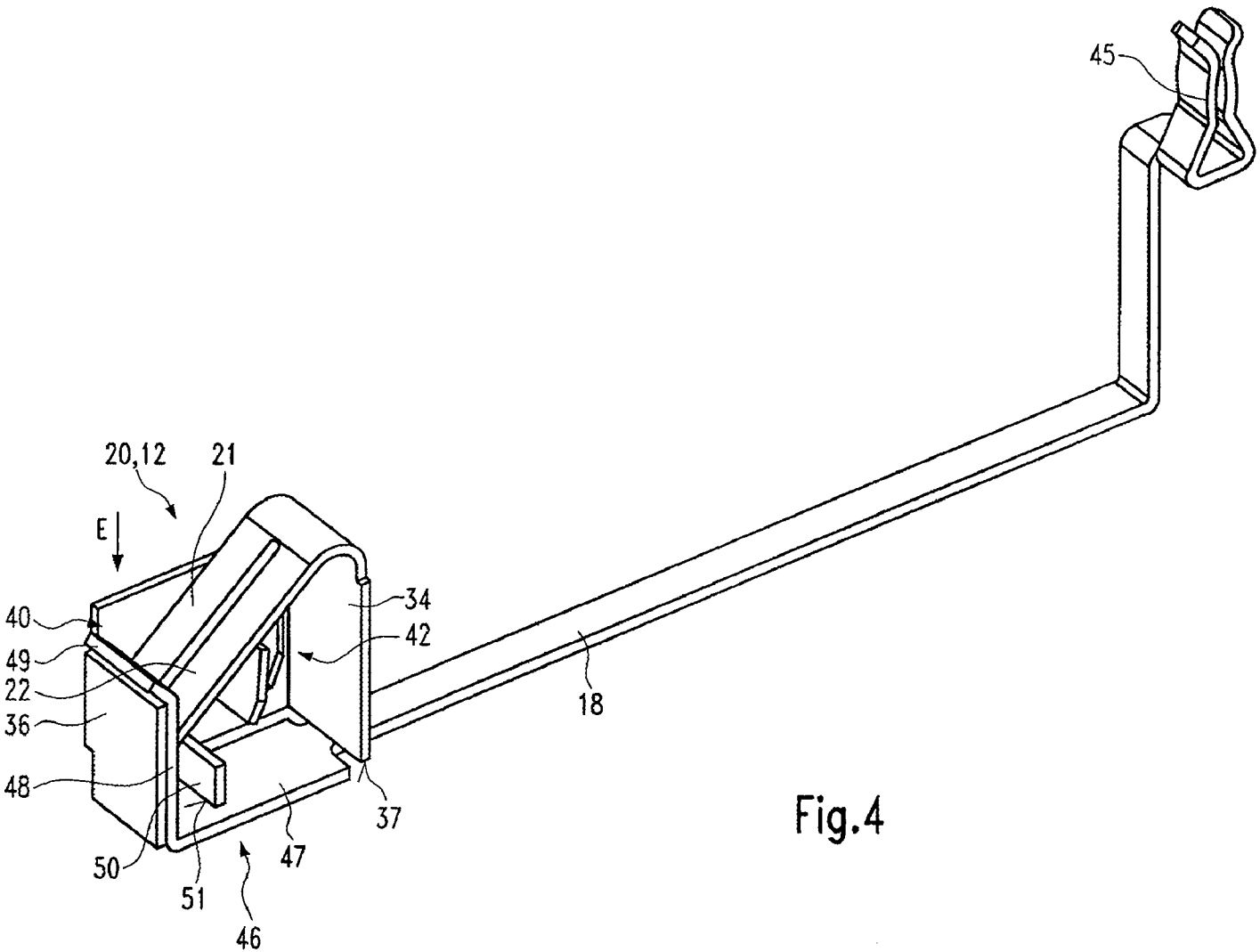
FIG. 4 shows a diagrammatic perspective view of the clamping device of FIG. 3 joined to a conductor to form a pre-assembled structural unit.

As shown in FIG. 4, shows the conductor element 18. The conductor element may be stamped out of a stamping material such as copper, for example, K55. The conductor element 18 extends from the clamping device 12 as far as the receiving region 2. The conductor element 18 lies against the underside 37 of the rear plate 34 and the underside 51 of the holding lug 50. At an end remote from the clamping device 12, the conductor element 18 has a clamp 45 for connecting with the pin (not shown) of the relay (not shown). The conductor element 18 has an end plate 46 arranged at the end of the conductor element 18 opposite from the clamp 45. The end plate 46 is bent substantially at a right angle to form a base 47 and a support member 48. The base 47 is longer than the support member 48 and forms a base plate for the cage 20. The base 47 covers the underside 51 of the holding lug 50 and prevents long conductor ends 13 from touching or damaging the housing 11 of the relay socket 1.

The support member 48 lies facing the interior space 41 of the cage 20, between the contact pressure plate 36 and the spring contacts 21, 22, and forms a conductor plate. The support member 48 arranged between the contact pressure plate 36 and the spring contacts 21, 22 makes it possible to make direct contact with the conductor element 18 through the conductor end 13 held by the spring contact 21, 22. In the illustrated embodiment, the spring contacts 21, 22 are deflected somewhat by the support member 48 such that the conductor element 18 is pressed against the contact pressure plate 36. A lip 49 is formed at an end of the support member 48. The lip 48 is configured to reach behind an upper end of the contact pressure plate 36 and projects into the recess 40. The lip 49 and the pressure of the spring contacts 21, 22 secure the conductor element 18 against displacement in the direction of insertion E.

The conductor element 18 and the clamping device 12 are therefore connected force-fittingly to one another without additional components to form a pre-assembled structural unit, which can be handled as a single piece. This construction has the effect of creating a connection between the conductor element 18 and the clamping device 12, which is simple to make and sufficiently firm for assembly purposes. The conductor element 18 is not only secured against displacement in a direction transverse to the direction of insertion E by the spring force of the spring contacts 21, 22 but also in a direction parallel to the direction of insertion E by the lip 49 and the holding lug 50. Alternatively, the conductor element 18 may be formed in one piece with the clamping device 12 and/or the cage 20. A construction of this kind, however, requires a more complex stamping geometry with a considerably greater amount of waste than the above-described construction.

In the assembled condition, the cage 20, which consists of the rear plate 34, the side plate 35 and the contact pressure plate 36, lines at least three sides of the assembly chamber 17 of the housing 11. This results in a secure contact between the conductor end 13 and the clamping device 12 of the terminal 5 and sufficient protection against sparking. A fourth side of the assembly chamber 17 is lined by the conductor element 18, as shown in FIG. 4. In addition, the structure of the cage 20 is sufficiently resilient such that the cage 20 is capable of elastically deforming so that the cage 20 can be fixed in the assembly chamber 17 when inserted therein.

With the clamping device 12 according to the invention, it is possible to clamp the conductor end 13 in the main clamping slot 16 firmly and force-fittingly as a result of the force-fitting clamping when the spring contacts 21, 22 are deflected. By dividing the single leaf spring 15 into at least two of the spring contacts 21, 22, it is consequently possible to clamp a plurality of conductor ends 13 independently of one another firmly in the respective clamping slots 26, 27 of the spring contacts 21, 22. In this way, a plurality of the conductor ends 13 can be connected to a terminal, as formed by the leaf spring 15.

To release the conductor 8 from the clamping device 12, the tool 10 is guided into the conductor end receiving chamber 14 by the wall of the actuation opening 7. The tool 10 then presses the leaf spring 15 downwards in the direction of insertion E until the leaf spring 15 abuts against the stop 19 to enlarging the main clamping slot 16. The force exerted by the tool 10 is therefore absorbed by the stop 19. Further, damage to the spring contacts 21, 22 can be avoided, because the inclined abutment face 42 prevents the spring contacts 21, 22 from being bent around the stop 19 if the pressure on the guide slope 28, 29 is too high. The conductor 8 can then be removed from the clamping device 12.

As a result of the construction of the spring contacts 21, 22 of the clamping device 12, it is possible to mount a plurality of the conductor elements 18 or at least one of the conductors 8 and one of the linking members 9 of different diameters on the terminal 5 of an electrical component independently of one another without impairing the clamping action of the rest of the conductors 8 arranged on the terminal 5.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical component, comprising:

a housing having at least one terminal provided with an insertion opening configured for receiving at least one conductor end, the insertion opening communicating with an assembly chamber formed in the terminal;

a clamping device arranged in the assembly chamber, the clamping device having a leaf spring divided into at least two substantially parallel spring contacts by a parting slot, each of the spring contacts being deflectable in a direction of insertion of the conductor end and having a free end positioned adjacent to a contact pressure plate such that a clamping slot is formed there between that force-fittingly receives the conductor end; and a conductor element extending from the clamping device and fixed thereto, the conductor element including a support member arranged between the free ends of the spring contacts and the contact pressure plate, the support member including a lip that engages the contact pressure plate to secure the support member against displacement in the direction of insertion of the conductor end, the free ends of the spring members engaging the support member to force-fittingly attach the conductor element to the clamping device.

2. The electrical component of claim 1, wherein the electrical component is a relay socket.

3. The electrical component of claim 1, wherein each of the spring contacts includes a guide slope inclined in the direction of insertion towards the clamping slot.

4. The electrical component of claim 1, further comprising a stop provided adjacent to undersides of the spring contacts, the stop being configured to limit the deflection of the spring contacts in the direction of insertion.

5. The electrical component of claim 4, wherein the stop includes an abutment face inclined in the direction of insertion towards the clamping slot.

6. The electrical component of claim 1, further comprising an actuation opening arranged adjacent to the insertion opening configured for receipt of a tool.

7. The electrical component of claim 1, wherein each of the spring contacts has a curved deformation region at an end opposite from the free end, the deformation region having a greater deflection capacity than a remainder of the spring contacts such that any elastic deformation of the spring contact substantially takes place at the deformation region.

8. The electrical component of claim 7, wherein each of the deformation regions have a transition radius that is a multiple of a thickness of the spring contacts.

9. The electrical component of claim 1, wherein the clamping device includes a cage that substantially surrounds the leaf spring and is integrally formed therewith.

10. The electrical component of claim 9, wherein the cage includes a rear plate, a side plate, and the contact pressure plate and the leaf spring extends from the rear plate of the cage.

11. The electrical component of claim 9, wherein the cage elastically deforms to fix the clamping device in the assembly chamber.

12. The electrical component of claim 1, wherein the clamping device is formed from a single metal sheet.

13. The electrical component of claim 1, wherein the conductor element has an end remote from the clamping device configured for receiving a pin.

14. The electrical component of claim 1, wherein the conductor element and the clamping device are force-fittingly connected to each other to form a single piece pre-assembled unit.

* * * * *